US009782985B2

(12) United States Patent
Campanini

(10) Patent No.: US 9,782,985 B2
(45) Date of Patent: Oct. 10, 2017

(54) PRINTING DEVICE AND METHOD FOR CONTROLLING THE PRINTING DEVICE

(71) Applicant: CUSTOM S.P.A., Fontevivo (IT)

(72) Inventor: Alberto Campanini, Fidenza (IT)

(73) Assignee: CUSTOM S.P.A., Fontevivo (Parma) (IT)

( * ) Notice: Subject to any disclaimer, the term of this patent is extended or adjusted under 35 U.S.C. 154(b) by 0 days.

(21) Appl. No.: 15/124,508

(22) PCT Filed: Feb. 24, 2015

(86) PCT No.: PCT/IB2015/051376
§ 371 (c)(1),
(2) Date: Sep. 8, 2016

(87) PCT Pub. No.: WO2015/136397
PCT Pub. Date: Sep. 17, 2015

(65) Prior Publication Data

US 2017/0015120 A1 Jan. 19, 2017

(30) Foreign Application Priority Data

Mar. 12, 2014 (IT) ..... MO2014A0061

(51) Int. Cl.

| | |
|---|---|
| ***B41J 15/04*** | (2006.01) |
| ***B41J 3/407*** | (2006.01) |
| ***B41J 11/00*** | (2006.01) |
| ***B41J 11/46*** | (2006.01) |

(52) U.S. Cl.
CPC ..... *B41J 15/048* (2013.01); *B41J 3/4075* (2013.01); *B41J 11/009* (2013.01); *B41J 11/46* (2013.01)

(58) Field of Classification Search
CPC ..... B41J 11/002; B41J 2002/17569; B41J 11/0015; B41J 13/0009; B41J 2002/012; B41J 3/4075; B41J 11/009; B41J 11/46; B41J 15/048
See application file for complete search history.

(56) References Cited

U.S. PATENT DOCUMENTS

| | | | |
|---|---|---|---|
| 6,934,043 | B1 | 8/2005 | Sugiyama et al. |
| 2003/0025779 | A1 | 2/2003 | Miyazaki |
| 2009/0167013 | A1 | 7/2009 | Horikoshi |
| 2010/0053663 | A1 | 3/2010 | Qian |
| 2010/0238255 | A1 | 9/2010 | Inaba |

FOREIGN PATENT DOCUMENTS

| | | | |
|---|---|---|---|
| EP | 1977900 | A1 | 10/2008 |
| JP | H0624047 | A | 2/1994 |

OTHER PUBLICATIONS

International Search Report & Written Opinion of the International Searching Authority Application No. PCT/IB2015/051376 Completed: Jun. 15, 2015;Mailing Date: Jun. 23, 2015 14 pages.

*Primary Examiner* — Lamson Nguyen
(74) *Attorney, Agent, or Firm* — Whitmyer IP Group LLC

(57) ABSTRACT

A printing device is disclosed including a path for supplying thermal paper unwound from a roll to a thermal print head arranged for printing on a first side of paper, wherein a linear image sensor is arranged along the path, on a second side of paper opposite the first, transversely to an advancement direction of the paper, to detect the position of an alignment mark arranged on the paper.

10 Claims, 2 Drawing Sheets

PRINTING DEVICE AND METHOD FOR CONTROLLING THE PRINTING DEVICE

CROSS-REFERENCE TO RELATED APPLICATIONS

This application is a national phase of PCT International Application No. PCT/1B2015/051376 filed Feb. 24, 2015. PCT/IB2015/051376 claims priority to IT Application No. MO2014A000061 filed Mar. 12, 2014. The entire contents of these applications are incorporated herein by reference.

TECHNICAL FIELD

The invention relates to a printing device and a method of controlling the same, which are in particular usable for printing on thermal paper unwound from a roll.

Specifically but not exclusively, the invention can be applied for real time printing of tickets, payment slips, receipts, etc.

BACKGROUND

In particular, the present invention refers to a printing device made in accordance with the preamble of the first claim. Such a device is already known, for example from patent publication EP 1977900.

One problem of known printing devices is to detect the position of the alignment marks arranged on the paper for suitable control of printing. For this purpose, using a photocell arranged along the path of the alignment mark is known. Nevertheless, the position of the alignment mark can vary from one type of paper to another. For this reason, the position of the photocell is, in general, adjustable, in a manual or motor-driven manner, to adapt the position of the photocell to the different positions of the alignment mark according to the type of paper. It is known, for example, to mount the photocell on a carriage that is slidable in a direction that is normal to the advancement direction of the paper. This solution is used, in particular, in the presence of a multi-supplying unit having several paper magazines, each with a different type of paper, supplied selectively to the print head according to the type of document to be printed.

In general, at each change of the type of paper, the photocell must be positioned at the point where the passage of the alignment mark is envisaged. This entails both a constructional complication because of the arrangement of the positioning system of the photocell and an operational complication because of the need to adjust the position of the photocell at each change of the type of paper.

SUMMARY

One object of the invention is to devise a printing device that is able to remedy the aforesaid limits and drawbacks of the prior art.

One advantage is detecting simply and immediately the position of an alignment mark arranged on the paper.

One advantage is detecting an alignment mark without adjusting the position of a sensor and for any type of paper that is usable in the printing device.

One advantage is enabling the sensor to be used that detects the position of the alignment marks also for reading other data arranged on the paper, for example pre-printed coded data.

One advantage is providing a printing device (in particular a device arranged for printing tickets and/or payment slips and/or receipts and/or labels or the like) that is constructionally simple and cheap.

One advantage is enabling printing of labels in a continuous format to be coordinated using for this purpose the sensor arranged for positioning the alignment marks.

One object of the invention is to make available a control method that is able to remedy the aforesaid limits and drawbacks of the prior art.

Such objects and advantages, and still others, are achieved by the device and by the method according to one or more of the claims set out below.

In one embodiment, a printing device comprises a (thermal) print head, which is arranged for printing on a first side of paper, and a (linear) image sensor, which is arranged along a path of the paper transversely to an advancement direction of the paper to read a second side of paper opposite the first, in particular to read an alignment mark arranged on the paper.

In one embodiment, a printing device comprises a path for supplying (thermal) paper to a (thermal) print head, wherein a (linear) image sensor is arranged along said path upstream of said print head, in particular for reading an alignment mark arranged on the paper.

Each of the (linear) image sensors mentioned above may comprise, in particular, a CCD or CIS scanning sensor.

BRIEF DESCRIPTION OF THE DRAWINGS

The invention can be better understood and implemented with reference to the attached drawings that illustrate embodiments thereof by way of non-limiting examples.

DETAILED DESCRIPTION

Figure 1:
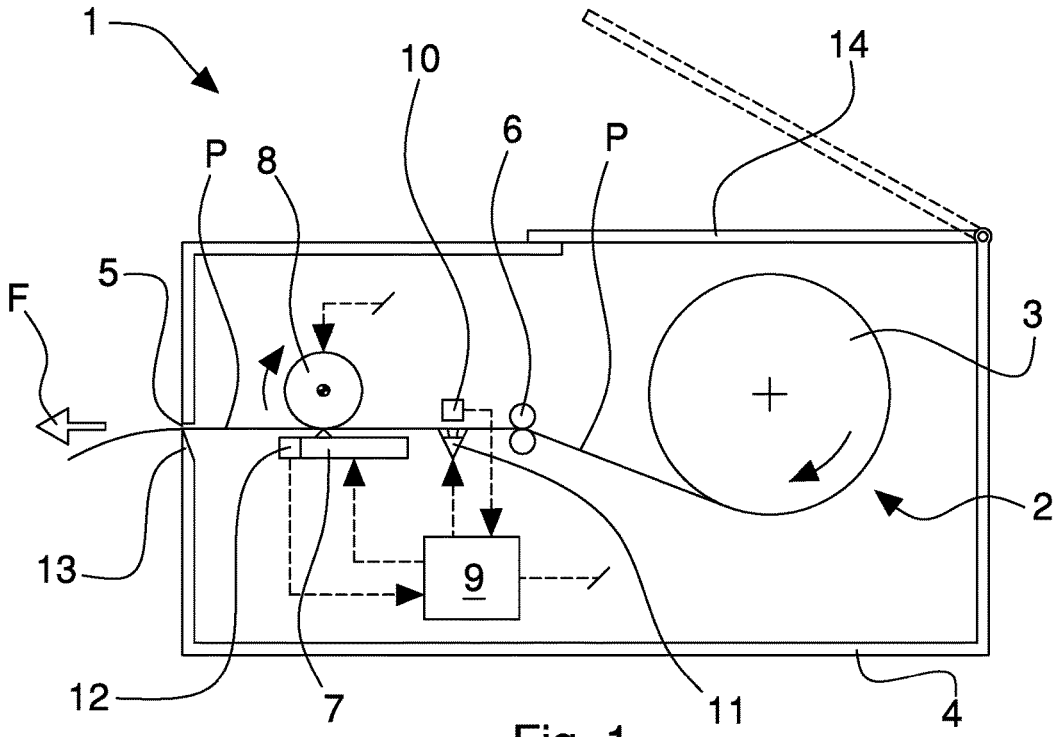
FIG. 1 is a diagram of one embodiment of a printing device made according to the invention.
Figure 2:
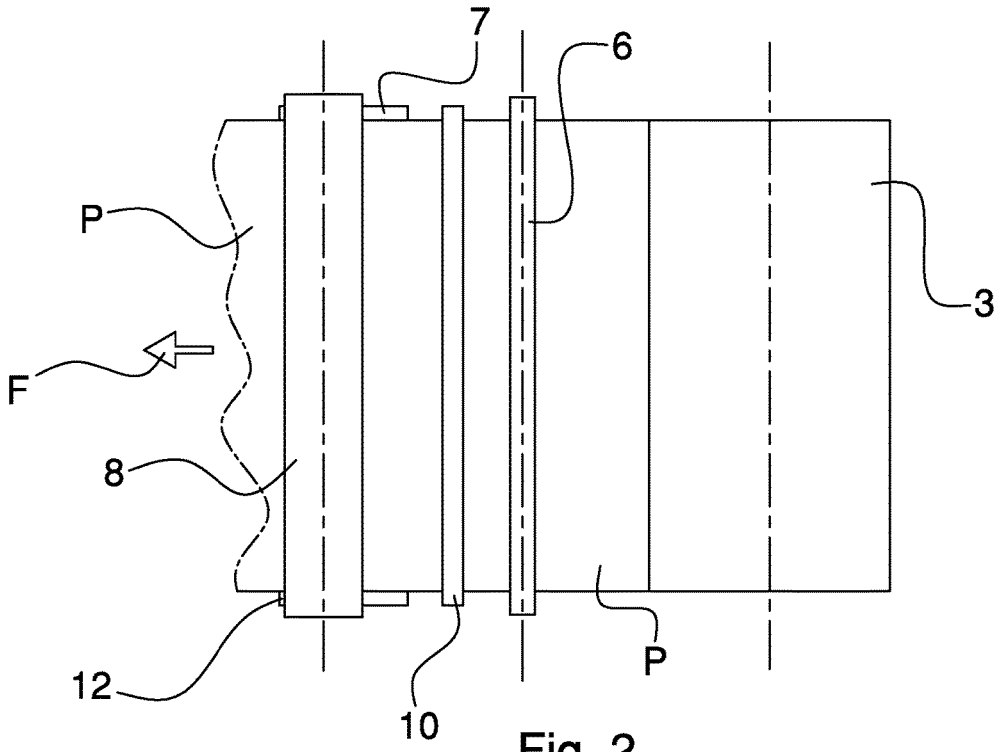
FIG. 2 is a diagram of a top plan view of FIG. 1 with some parts removed to highlight others better.

With reference to the aforesaid figures, with 1 a printing device has been indicated overall, which is usable in particular for printing tickets, payment slips, receipts, labels or other types of documents printed in real time.

The printing device 1 may comprise, in particular, a magazine for housing printing paper or another type of printing support. The printing support that is usable by the printing device in question may be, in particular, paper, for example thermal paper. In this patent document (description and claims), "paper" or "printing paper" is defined as any type of printing support that is suitable for printing (in particular with a thermal print head), for example a material that is printable in the form of a strip, in particular wrapped in a roll, like a roll of (thermal) paper, or a set of sheets in continuous fan-fold format, or a set of separate sheets (made of paper or of another printable material), or a set of sheets (for example labels) arranged in a row on a support in the form of a strip, etc.

In the specific case the magazine may comprise, in particular, at least one seat 2 arranged for receiving at least one roll 3 of thermal paper. The magazine may, nevertheless, comprise other types of paper magazines (also of known type).

The printing device 1 may comprise, for example, a containing body, or case 4, (for example in box form) that is suitable for containing the various components of the printing device or at least a part thereof.

The printing device 1 may comprise, in particular, a path for supplying the paper P coming from the magazine (unwound from the roll 3) to an outlet 5 where the user can remove the printed document. The outlet 5 may be arranged, for example, on a wall of the case 4. The outlet 5 may comprise a (horizontal) slit. The outlet may comprise an outlet mouth that protrudes from a wall of the case. The path of the paper may comprise, for example, one or more tensioning rollers 6.

The printing device 1 may comprise, in particular, a print head 7, for example a thermal print head, arranged along the paper path for printing on a first side of the paper P (for example a thermally sensitive side). A dragging roller 8 opposite the print head 7 may be operationally associated with the print head 7. The roller 8 operates in contact with a second side of paper (opposite the first printable side). The path of the paper P will pass between the print head 7 and the dragging roller 8. The roller 8 will be controlled (by a programmable electronic controller 9) cooperating with the print head 7, to advance the paper P in a coordinated manner during printing.

The printing device 1 may comprise, in particular, at least one linear image sensor 10 arranged transversely (in particular perpendicularly) to an advancement direction F of the paper P along the aforesaid path, in particular for reading the second side of paper (opposite the first printable side). It is nevertheless possible to use a linear image sensor arranged along the aforesaid path (upstream of the print head) to read the first side of paper (instead of or in addition to the sensor arranged to read the second side of paper).

The linear image sensor 10 may comprise, in particular, a CCD or CIS scanning sensor. The linear image sensor 10 may be extended linearly, as in this specific case, for a width of path that is suitable for reading (simultaneously or almost simultaneously) an entire width of paper (at the passage of the paper), for any type of paper that is usable in the printing device.

The linear image sensor 10 may be arranged, as in this specific example, upstream of the print head 7. It is nevertheless possible to use a linear image sensor 10 arranged to read the second side of the paper downstream of the print head (instead of or in addition to the upstream sensor).

The printing device 1 may comprise, in particular, a light source 11 (for example a LED or a series of LEDs or other type/types of lamp/s) arranged opposite the linear image sensor 10 to illuminate the first side of paper such that the linear sensor 10 is able to detect effectively when a transparency difference of the paper P passes in front of the sensor, in particular to detect a transparency bound in the paper that traverses the path. This function may be useful, for example, for coordinating label printing, detecting the transparency bound between the edge of each label and the supporting strip of the labels that are arranged in a row of labels in a continuous format. The light source 11 may be arranged on the first side of paper or on the second side of paper, according to whether the linear sensor 10 is arranged, respectively, on the second side of paper or on the first side of paper.

The printing device 1 may comprise, in particular, at least one further linear image sensor 12 (for example a CCD or CIS scanning sensor) arranged along the paper path to read the first side of paper (immediately) downstream of the print head 7. This further sensor 12 may be integrated into the print head 7.

The printing device 1 may comprise, in particular, a cutting device for separating the printed document from the rest of the paper. This cutting device may comprise, as in this embodiment, a stationary blade 13 (so that the document will be separated by the user when a flap that has exited the outlet 5 is pulled), or at least one motor-driven blade (of known type).

The printing device 1 may comprise, in particular, a closing arrangement of the seat 2 that receives the paper P to be printed. This closing arrangement may comprise, in particular, a movable closing element, such as for example a shutter or gate or door 14. The door 14 may have an opening and closing movement around a pivot. This closing arrangement may have, in particular, an automatic opening system (also of known type, for example a system comprising a door opening spring and an electromagnetically driven movable element that disengages a door locking arrangement) that opens the closing arrangement at the command of the electronic controller 9.

Figure 3:
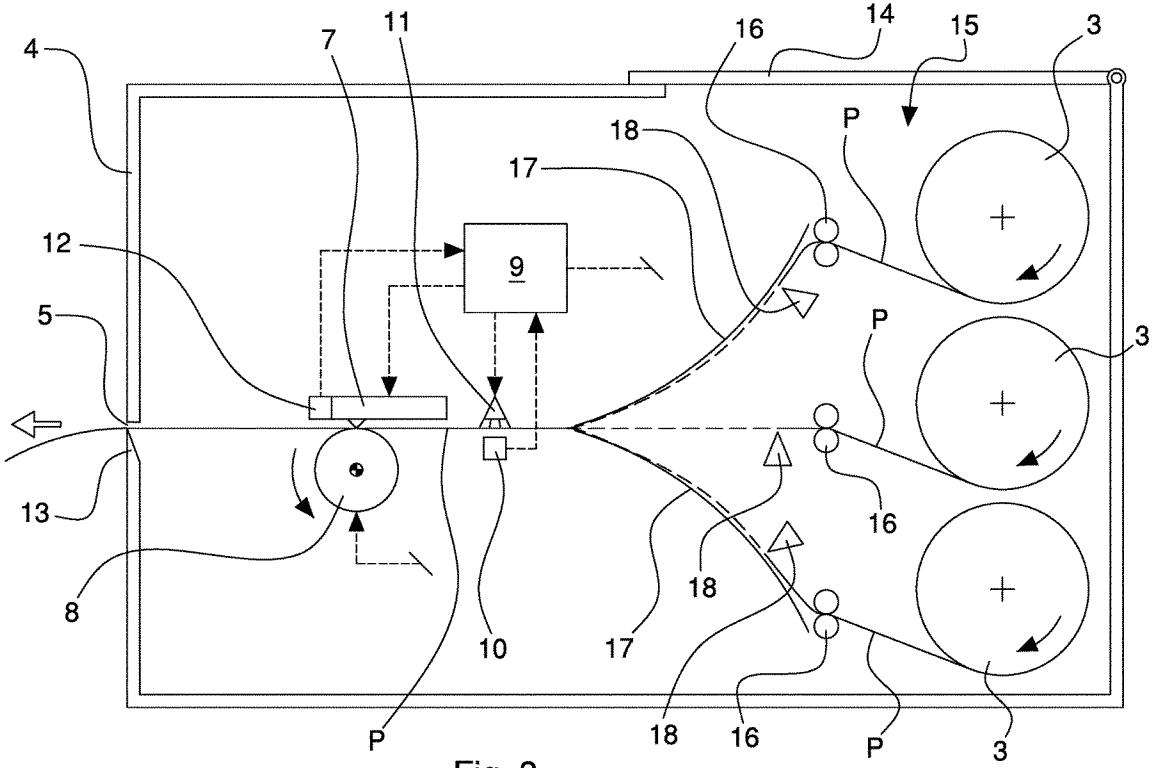
FIG. 3 is a diagram of another embodiment of a printing device made according to the invention.

With reference to the embodiment of FIG. 3, the printing device may comprise, as in this case, a multi-supplying unit 15 having two or more paper magazines (in this case three magazines) arranged for being selectively connected to the print head 7. Each magazine may be provided for containing a different type of paper. The various magazines may comprise, for example, rolls of thermal paper 3 or other types of magazine of print supports.

The multi-supplying unit 15 may comprise, in particular, an arrangement for supplying selectively the paper of the desired magazine to the print head 7 (according to the type of document that it is desired to print). Such supplying arrangement may comprise, as in this embodiment, a (roll) dragging arrangement 16 associated with each paper magazine. Each of the (roll) dragging arrangement 16 may be driven and controlled by the controller 9 to unwind the paper independently from each magazine (roll 3). This arrangement for supplying the paper may comprise a guiding arrangement 17 (for example guiding walls or channels) for guiding the paper coming from each paper magazine to the print head 7. In practice, the guiding arrangement 17 defines two or more path portions of the paper (an independent portion of path for each paper magazine). The guiding arrangement 17 is arranged, in particular, downstream of the dragging roller arrangement 16.

It is possible to arrange, as in this case, two or more cutting devices 18 (one for each paper magazine or for each portion of path) to separate the paper downstream of the (roll) dragging arrangement 16. These cutting devices 18 may be driven (and controlled by the controller 9).

The printing device 1 may comprise, in particular, the aforesaid programmable electronic controller 9 (comprising for example an electronic board connected to the various sensors and to the various actuators of the printing device) and programme instructions that are implementable on this programmable controller 9 to perform the following steps of a control method of the printing device 1.

A first step comprises receiving data on the desired position (in particular the position along a transverse dimension or width of the paper P) of at least one paper alignment mark arranged on the paper. As said, the paper alignment mark may comprise a notch, a hole, a preprinted mark in the form of a spot or symbol or other type of mark. The paper alignment mark may be used by the controller 9, in a known manner, to control suitably printing, in particular for forming correct printing in the desired position by coordinating the advancement of the paper P (operated for example by the roller 8) with the operation of the print head 7.

This first step may involve the use of a user interface (known and not illustrated), for example a graphic interface comprising a screen.

In this first step the user may provide the electronic controller 9 (for example by means of a touchscreen associated with the screen or a keyboard) the information relating to the type of paper to be used in printing, information that may also include the data on the position of the alignment mark found on that type of paper. In this manner, the controller 9 can receive and store in a memory the data on the desired position of the alignment mark that has to be present on the paper intended for being printed.

second step may comprise receiving from the linear image sensor 10 data on the actual detected position of a paper alignment mark. In this second step the paper P is advanced (for example by the paper dragging roller 8 or another paper advancement arrangement with which the printing device 1 may be provided) along the paper path. During the advancement, the paper alignment mark will be detected by the linear image sensor 10, whatever the type of paper and thus the position of the alignment mark along the width of the paper. The image sensor 10 will then send to the electronic controller 9 the signal/s relating to the actual detected position of the alignment mark.

A third step may comprise comparing the data (acquired by the sensor 10) on the actual position of the alignment mark with the data (supplied by the user during the printing device setting step) on the desired position.

A fourth step may comprise emitting an alarm signal (for example an acoustic signal and/or a visible signal on the screen of the user interface and/or a signal that is suitable for locking the print head and/or for locking the paper advancement and/or a signal that automatically opens the door 14 to prompt the user to change paper and/or another signal to suggest to the user that the paper being used is not suitable for the printing setting, etc) if the position actually detected by the sensor 10 does not correspond to the desired preset position.

The control method disclosed above enables printing to be interrupted if the paper P inserted into the magazine of the printing device does not correspond to the paper that has to be used on the basis of the printing settings. In fact, the controller 9 is able to determine whether the actually detected position of the alignment mark matches or not to the preset position. The lack of matching can be caused by an error in the type of paper inserted by the user, or by an error in the insertion operation (for example insertion in the opposite direction of the roll of paper with the printable side overturned), or by a setting error, or by still other causes. The controller 9 may then interrupt printing and send to the user an error signal to suggest a corrective action. In particular, the controller 9 proceeds with the set printing only if the layout of the alignment mark/s coincides with the previously stored desired layout.

The printing device 1 may comprise, in particular, programme instructions that are implementable on the electronic controller to perform the following steps: receiving setting data for printing to be performed; reading preprinted data on the second side of paper P by means of the linear image sensor 10; comparing the preprinted data read by the sensor 10 with the setting data; and emitting an alarm signal if the preprinted data read by the sensor are not compatible with the setting data.

In practice, the linear image sensor 10 may be controlled to read the preprinted data, for example information written on the second side of paper in coded form, in particular a barcode 1D or 2D, and to send these data to the controller 9, which is programmed for verifying whether the preprinted data correspond to a type of data or document to be printed that is compatible with the printing settings. This enables printing to be interrupted if the user has inserted into the magazine a type of paper P that is not suitable with the printing settings. The user can thus realise if there has been an error in inserting the type of paper or in setting the printing device.

The same linear image sensor 10 may thus be used to perform various functions: detecting the position of the paper aligned mark/s (to enable the printing work to be coordinated correctly) whatever the position or the layout of the alignment mark/s along the width of the paper (without any need to position the sensor, which is able to read the entire width of the path), enabling a position error to be reported that is due, for example, to inserting a type of paper that is different from the set type of paper; reading information arranged on the side that is not intended for printing of the paper, for example coded information (like a 1D or 2D barcode or other type of code); detecting the position of a transparency bound in the paper P, in particular the transparency bound defined by an edge of a label in a series of continuous format labels, to check document printing.

The invention claimed is:

1. A ticket printing device comprising:

a path for supplying printing paper towards an outlet of a printed document;

a print head arranged along said path for printing on at least a first side of the paper;

at least one image sensor of linear type arranged transversely to a paper advancement direction along said path for reading a paper alignment mark on a second side of paper opposite the first side of paper, wherein said at least one image sensor extends linearly for a width of said path that is suitable for reading an entire width of paper so that said image sensor detects a paper alignment mark on the paper during the paper advancement whatever the position of the paper alignment mark along the width of the paper; and a programmable electronic controller and program instructions implementable on said controller for running the steps of:

receiving data relating to the desired position of at least one paper alignment mark arranged on the paper;

receiving from said at least one image sensor data relating to the actual position of a paper alignment mark;

comparing the data relating to the actual position of the alignment mark with the data relating to the desired position.

2. The printing device according to claim 1, comprising a paper multi-supplying unit having two or more paper magazines supplied selectively to said print head.

3. The printing device according to claim 1, said controller emitting a signal on the basis of said comparing.

4. The printing device according to claim 1, comprising program instructions implementable on said controller for running the steps of:

receiving setting data of printing to be performed;

reading pre-printed data on the second side of paper by said at least one image sensor;

verifying whether said data read by the sensor are compatible or not with the setting data; and emitting a signal on the basis of said verifying.

5. The printing device according to claim 1, comprising a light source arranged opposite said at least one image sensor to illuminate the first side of paper in such a manner that said sensor is able to detect the transparency of the paper, in particular to detect a transparency difference, for example to coordinate printing of a series of labels in a continuous format.

6. The printing device according to claim 1, comprising at least one further image sensor arranged along said path to read the first side of paper downstream of said print head.

7. The printing device according to claim 1, wherein said image sensor is arranged upstream of said print head.

8. The printing device according to claim 1, wherein said image sensor comprises one CCD or CIS scanning sensor.

9. The printing device according to claim 1, wherein said print head is of thermal type and/or wherein said printing device is suitable for printing tickets.

10. The printing device according to claim 1, comprising a device for interrupting printing if said sensor reads data on the paper that are not compatible with setting data of printing to be performed.

* * * * *